United States Patent [19]

Nicoletta et al.

[11] Patent Number: 4,715,639

[45] Date of Patent: Dec. 29, 1987

[54] GRASPING UTENSIL

[76] Inventors: Roger A. Nicoletta; Emil Downey, both of 34 Connecticut Blvd., E. Hartford, Conn. 06018

[21] Appl. No.: 938,008

[22] Filed: Dec. 4, 1986

[51] Int. Cl.[4] ..... A47G 21/10; B25B 9/02

[52] U.S. Cl. ..... 294/99.2; 294/33

[58] Field of Search ..... 294/99.2, 33, 16, 118, 294/8.5, 3, 11, 28, 29, 31.1

[56] References Cited

U.S. PATENT DOCUMENTS

| | | | |
|---|---|---|---|
| 3,892,435 | 7/1975 | Huey | 294/99.2 |
| 4,073,533 | 2/1978 | Debrey et al. | 294/118 |
| 4,199,180 | 4/1980 | Kelly | 294/16 |
| 4,226,459 | 10/1980 | Natalicio | 294/33 |
| 4,312,530 | 1/1982 | Young | 294/99.2 |

FOREIGN PATENT DOCUMENTS

| | | | |
|---|---|---|---|
| 970972 | 1/1951 | France | 294/16 |

OTHER PUBLICATIONS

Toast Tongs (Nov.-Dec. 1971).

*Primary Examiner*—James B. Marbert

*Attorney, Agent, or Firm*—McCormick, Paulding and Huber

[57] ABSTRACT

A hand-operated utensil for grasping and picking up articles or food is comprised by a pair of elongated stick members arranged in intersecting relationship at a midpoint of the members. The members are integrally connected at the intersection, and the lower portions of the elements at one side of the intersection are made flexible toward and away from each other by a recess or recesses forming flex hinges in the members.

8 Claims, 8 Drawing Figures

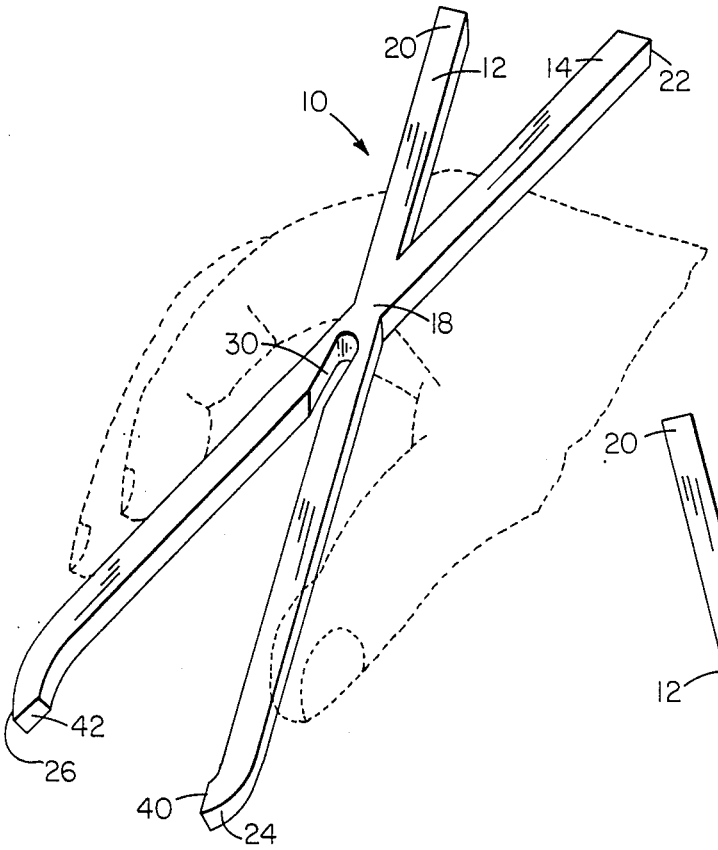
FIG. 1
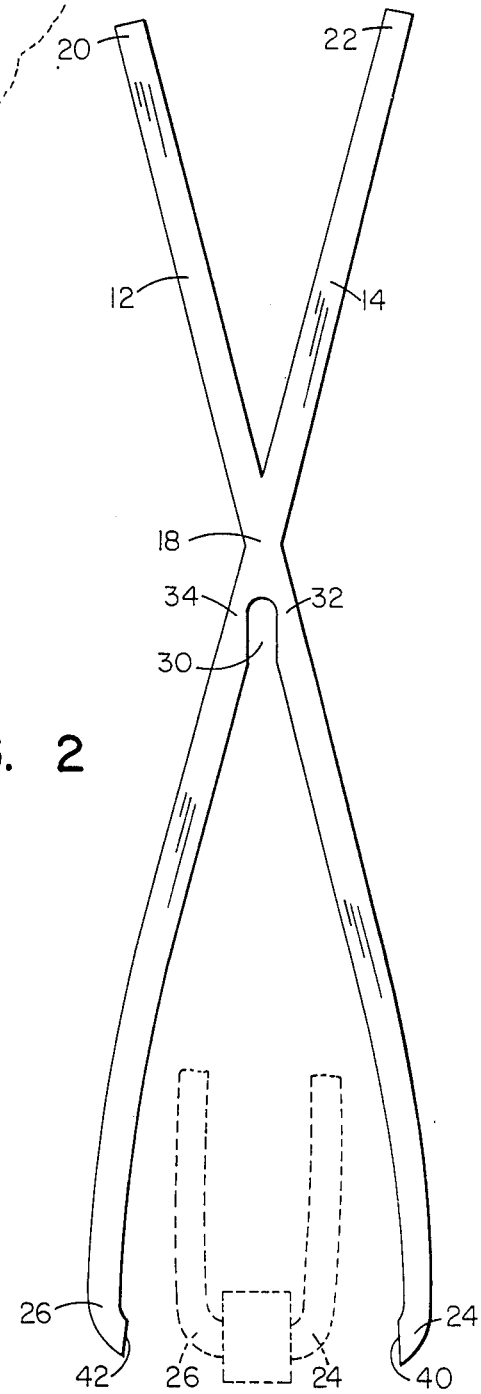
FIG. 2
FIG. 3
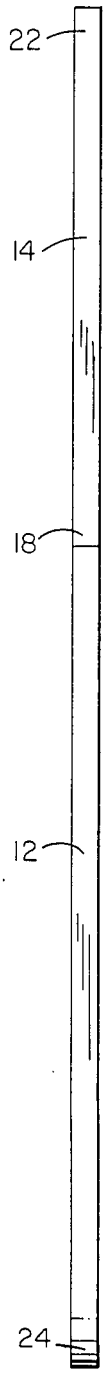

GRASPING UTENSIL

BACKGROUND OF THE INVENTION

The present invention relates to utensils and is concerned, more particularly, with a hand-operated utensil resembling a pair of chopsticks for grasping articles or food.

Eating utensils comprised of elongated elements such as chopsticks that are manipulated to grasp pieces of food between the lower ends of the sticks are well known and have been used for centuries. The manner of manipulating separate sticks in pairs can be mastered with continuous or extensive practice, but for those who have an occasional encounter with such implements, the eating process is awkward and is managed with varying degrees of success.

Simplified chopstick-type utensils or accessories have been invented for the less practiced or skillful to ease the process of eating when no other alternatives are offered. U.S. Pat. Nos. 2,997,328, 3,186,749, 3,239,262 and 3,501,191 all disclose accessories that make the use of chopstick devices much easier for the novice. U.S. Pat. Nos. 3,640,561 and 3,892,436 further reveal chopstick-type devices which are integrally interconnected for flexible movement of the sticks toward and away from each other. U.S. Pat. No. 4,012,068 discloses a tong or tweezer utensil for picking up articles or objects other than food.

SUMMARY OF THE INVENTION

The present invention pertains to a hand-operated utensil for grasping and placing food in the mouth or picking up other objects, and is comprised by a pair of elongated handling and grasping elements or sticks having corresponding upper and lower ends. The elements are arranged in interesting and integrally connected relationship at a position of intersection intermediate the ends of the sticks, and the lower portions of the elements between the intersection and the lower ends are flexible toward and away from each other to form a tweezers for grasping objects between the lower ends. The upper portions of the sticks between the intersection and the upper ends are rigid relative to one another and define a stationary base support in the hand.

In use, the utensil is held in the hand with the flexing lower portion of the elements between the thumb and fingers. The relatively rigid upper portions rest and are supported against the base of the fingers and hand while the thumb and fingers squeeze the flexible lower portions toward each other to grasp pieces of food and other objects. The lower ends of the sticks may be specially adapted to engage food and may include pointed ends for spearing objects or specially shaped ends for capturing or holding substances of various consistencies, such as pastes or even liquids.

The novel utensil is easily constructed from plastic and other materials, and is manipulated with ease and without requiring great skill and dexterity.

BRIEF DESCRIPTION OF THE DRAWINGS

FIG. 1 is a perspective view of the hand-operated utensil of the present invention in one embodiment.

FIG. 2 is a plan view of the hand-operated utensil shown in FIG. 1.

FIG. 3 is a side elevation view of the utensil in FIG. 2.

DESCRIPTION OF THE PREFERRED EMBODIMENTS

Figure 4:
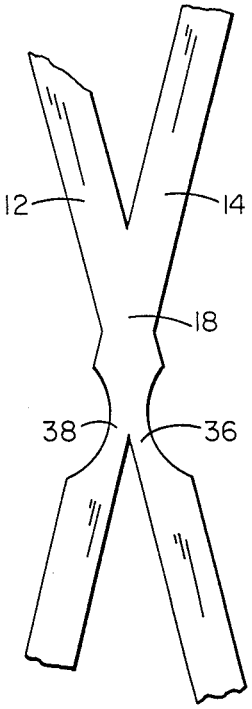
FIG. 4 is a fragmentary view of the utensil at the midsection of the stick elements in another embodiment of the invention.

FIG. 1 illustrates the utensil of the present invention in one embodiment for grasping food or other articles, and shows how the utensil is held and operated in the hand. The utensil, generally designated 10, has a one-piece construction suitable for manufacture by molding, stamping, cutting and other processes. The utensil can be prepared from plastic, wood, metals, composites or other materials which do not fracture under light stressing.

Utensil 10 is comprised primarily of two elongated elements or sticks 12 and 14 in an x-shaped configuration. As shown in FIGS. 1 and 2 the sticks are arranged in intersecting relationship with the intersection 18 being at the midsection of the sticks between the upper ends 20, 22, and article-engaging lower ends 24, 26 respectively. At the intersection 18 the sticks are integrally interconnected and are joined or merge with one another to a sufficient extent that the upper portions of the sticks are rigid relative to one another and provide structural support for the utensil when held in the hand as shown in FIG. 1. The upper portions diverge away from one another between the intersection 18 and the upper ends and thereby provide a stationary, non-flexing, broad based support in contact with the knuckle area of the hand when the utensil is held with the lower portions and the intersection between the thumb and forefinger. Below the intersection, the lower portions form a flexible tweezers for grasping food and other articles.

Although the sticks 12 and 14 are referred to herein as individual elements, it should be understood that in the integral form of the utensil, no identifiable division between the sticks exists. Although the sticks are illustrated in FIG. 1 as having a square transverse cross section, the sticks may be octagonal, rectagonal, round and combinations of these and other cross sections, at various stations long their lengths.

It is an important feature of the invention that the lower portions of the sticks between the intersection 18 and the lower ends 24 and 26 are flexible toward and away from each other for grasping food and other articles between the ends and picking the articles up. For this purpose an oblong or elongated, stress-relieving recess or slot 30 is cut or formed between the lower portions of the sticks and extends upwardly into the intersection 18 at the apex of the angle between the lower portions. The innermost end of the slot is rounded to prevent stress concentrations and preferably has a semicylindrical shape open at each side of the utensil.

As shown most clearly in FIG. 2 the slot 30 extends into each stick and reduces the transverse cross sectional area adjacent the intersection 18. Thus, the slot forms flex hinges 32, 34 by which the lower portions are connected respectively to the rest of the utensil. The axis of each flex hinge extends generally parallel to the axis of the seimcylindrical surface of the slot 30 and perpendicular to the plane of the sticks so that the lower portions are freely flexed toward each other to engage articles as shown in phantom in FIG. 2. The hinges permit flexing movement of the lower stick portions by hand, and at the same time guide the flexing movement in the plane of the unflexed sticks 12 and 14.

FIG. 4 illustrates an alternate configuration for the flex hinges adjacent the intersection 18. In this embodiment flex hinges 36 and 38 are formed in the sticks 12 and 14 respectively by means of cylindrical cut-outs on the outside edges of the sticks immediately below the intersection 18. Again, the hinges have axes which extend perpendicular to the plane of the sticks to allow flexing movement by hand and provide controlled guidance which moves the ends of the sticks in the same plane.

The lower ends of the sticks 12 and 14 shown in the embodiment of FIGS. 1–3 are slightly curved and have smooth, rounded, outside surfaces at the corners in order to prevent injury and provide comfort when food is inserted into the mouth. The ends also define flat pads or clamping surfaces 40, 42 for grasping articles between the sticks. However, other shapes and configurations of the sticks may be provided at one or both of the lower ends as shown in FIGS. 5–8.

Figure 5:
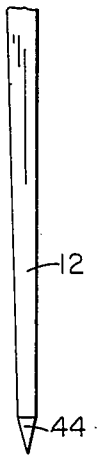
FIG. 5 is a fragmentary view of a stick element at one end in a further embodiment of the invention.

In FIG. 5 the one leg 12 is provided with a pointed end 44 for spearing pieces of food that are suitable for such handling. The pointed end 44 does not preclude the more conventional use of the utensil in which pieces of food or other articles are clamped between the sticks 12 and 14, especially if the opposite stick has a clamping surface such as illustrated in the embodiment of FIGS. 1–3.

Figure 6:
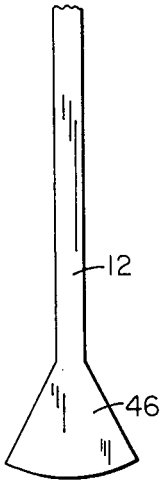
FIG. 6 is a fragmentary view of a stick element at one end in still a further embodiment of the invention.

FIG. 6 shows still a further embodiment in which the stick 12 has a widened or flared lower end 46. The flared end provides a larger surface area for maneuvering objects of various sizes or consistencies into position for grasping between the sticks.

Figure 7:
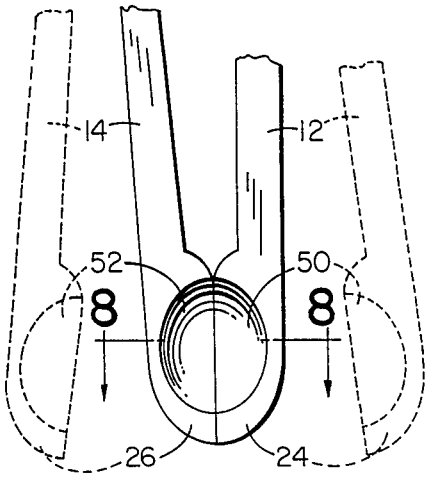
FIG. 7 is a fragmentary view of the stick elements in another embodiment and shows the ends of the sticks in both the and spread positions.
Figure 8:
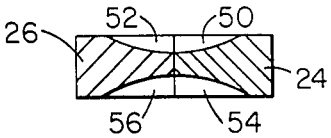
FIG. 8 is a cross sectional view of the stick elements as seen along the sectioning line 8—8 of FIG. 7.

FIGS. 7 and 8 illustrate still another embodiment of the sticks which is suitable not only for grasping articles, but also for spooning paste-like materials, such as cream corn, and liquids. As seen most clearly in the sectional view of FIG. 8, the sides of the lower ends 24, 26 of the sticks 12 and 14 bear cooperating concave depressions 50, 52 respectively. When the sticks are flexed from the open position in phantom to the closed position as shown, the depressions form a small bowl or scoop for holding liquid and semi-liquid materials. Depressions 54 and 56 are also provided on the opposite side of the ends 24, 26 respectively so that the instrument is basically symmetrical top and bottom and can be manipulated with either side up.

Still other configurations of the lower ends may be employed for special purposes without interfering with the grasping function of the utensil.

In summary, a hand-operated utensil is formed by integrally connected sticks which are flexed between the intersection and one end of the sticks to grasp and pick up food and other articles. The utensil is manipulated with ease due to the integral connection of the sticks at the midsection and the guidance provided by the flex hinges. The utensil is readily manufactured by a variety of conventional processes.

While the invention has been disclosed in several different embodiments, it should be understood that numerous modifications and substitutions can be had without departing from the spirit of the invention. For example, the sticks may have different cross sections than illustrated, and the cross sections may vary along the length of the stick without defeating the function of the utensil in any respect. The lower ends of the sticks can have a variety of shapes adapted to general or special purposes. A single flex hinge formed by a recess in one of the sticks may be provided to allow flexing movement of one lower end of a stick toward the other without movement of the other end relative to the upper portions of the sticks. Accordingly the present invention has been defined in several embodiments by way of illustration rather than limitation.

We claim:

1. A hand-operated utensil for grasping and picking upfood or other articles comprising : a pair of elongated handling and grasping elements, each having corresponding upper and lower ends, the elements being arranged in intersecting and integrally interconnected relationship at a position of intersection intermediate the upper and lower ends, the lower portions of the elements between the intersection and the lower ends being made flexible toward and away from each other for grasping articles with the lower ends by stress-relieving recess means including at least one recess extending into the lower portion of one element adjacent the intersection to reduce the transverse cross section of said one element at the recess and form a flex hinge permitting flexing movement of said one element toward the other element, and the upper portions of the elements between the intersection and the upper ends being rigid relative to one another and diverging away from one another for a distance between the intersection and the upper ends to thereby provide above the intersection a stationary, non-flexing and broad based support in contact with the knuckle area of the hand, and below the intersection, a flexible tweezers for grasping articles when the utensil is held with the lower portions and intersection between the thumb and forefinger.

2. A hand-operated utensil for grasping and picking up food or other articles as described in claim 1 wherein the lower portions of the elongated elements are made flexible toward and away from each other by stress-relieving recess means including a recess extending into each of the lower portions of the elements adjacent the intersection to reduce the transverse cross sections and form flex hinges in the lower portions of the elements.

3. A hand-operated utensil for grasping and picking up food or other articles as defined in claim 2 wherein the stress-relieving recess means comprises means defining a recess extending into the intersection of the elements at the apex of the angle between the lower portions of the elements.

4. A hand-operated utensil as defined in claim 3 wherein the recess has the shape of an oblong slot, the innermost end of the slot being semicylinderically shaped.

5. A hand-operated utensil as defined in claim 1 wherein the lower ends of the elements define clamping surfaces for grasping articles.

6. A hand-operated utensil defined in claim 5 wherein the lower ends of the elements have cooperating concave recesses which form a bowl when the lower ends are flexed and brought together.

7. A hand operated eating utensil as defined in claim 1 wherein the lower end of one element is pointed for spearing pieces of food.

8. A hand-operated utensil as defined in claim 1 wherein the lower end of one element is flared.

* * * * *